US006120619A

United States Patent [19]

Goudiakas et al.

[11] Patent Number: 6,120,619

[45] Date of Patent: Sep. 19, 2000

[54] PASSIVATION OF STAINLESS STEELS IN ORGANOSULPHONIC ACID MEDIUM

[75] Inventors: Jean Goudiakas, Laning; Guy Rousseau, Pau, both of France

[73] Assignee: Elf Atochem, S.A., France

[21] Appl. No.: 09/228,953

[22] Filed: Jan. 12, 1999

[30] Foreign Application Priority Data

Jan. 26, 1998 [FR] France ..... 98 00791

[51] Int. Cl.[7] ..... C23C 22/48

[52] U.S. Cl. ..... 148/271; 148/273; 422/12

[58] Field of Search ..... 148/270, 271, 148/273, 274, 287; 428/472.2; 422/12

[56] References Cited

U.S. PATENT DOCUMENTS

| | | | |
|---|---|---|---|
| 2,077,450 | 4/1937 | Weisberg et al. | 148/273 |
| 2,793,191 | 5/1957 | Streicher . | |
| 4,339,617 | 7/1982 | Imai et al. . | |
| 4,588,519 | 5/1986 | Kuhn | 282/389 |
| 4,933,436 | 6/1990 | Wolff et al. | 534/581 |
| 4,957,653 | 9/1990 | Cordani . | |

FOREIGN PATENT DOCUMENTS

| | | |
|---|---|---|
| 1012474 | 7/1952 | France . |
| 57-185989 | 11/1982 | Japan . |
| 2-302491 | 12/1990 | Japan . |
| 7-278854 | 10/1995 | Japan . |

OTHER PUBLICATIONS

European Search Report dated Sep. 28, 1998.

"The mechanism of passivating–type inhibitors", Journal of the Electrochemical Society, vol. 105, No. 11, pp. 638–647, (1958).

B. Gaur, et al., Corrosion of Metals and Alloys in Methane Sulphonic Acid, British Corrosion Journal, 1999, vol. 34, No. 1, pp. 63–66.

European Search Report dated May 7, 1999.

"Corrosion of Stainless Steel During Acetate Production", J.S. Qi and G. C. Lester, Corrosion Engineering, vol. 2, pp. 558–565 (previously cited as unavailable).

*Primary Examiner*—John Sheehan
*Assistant Examiner*—Andrew L. Oltmans
*Attorney, Agent, or Firm*—Smith Gambrell & Russell, L.L.P.

[57] ABSTRACT

To avoid the corrosion of stainless steels in organosulphonic acid medium, at least one oxidizing agent selected from cerium(IV), iron(III), molybdenum(VI) or vanadium(V) oxides or salts, nitrites and persulphates, is added to the medium in an amount which is sufficient to place the spontaneous potential between the passivation and transpassivation potentials.

23 Claims, 1 Drawing Sheet

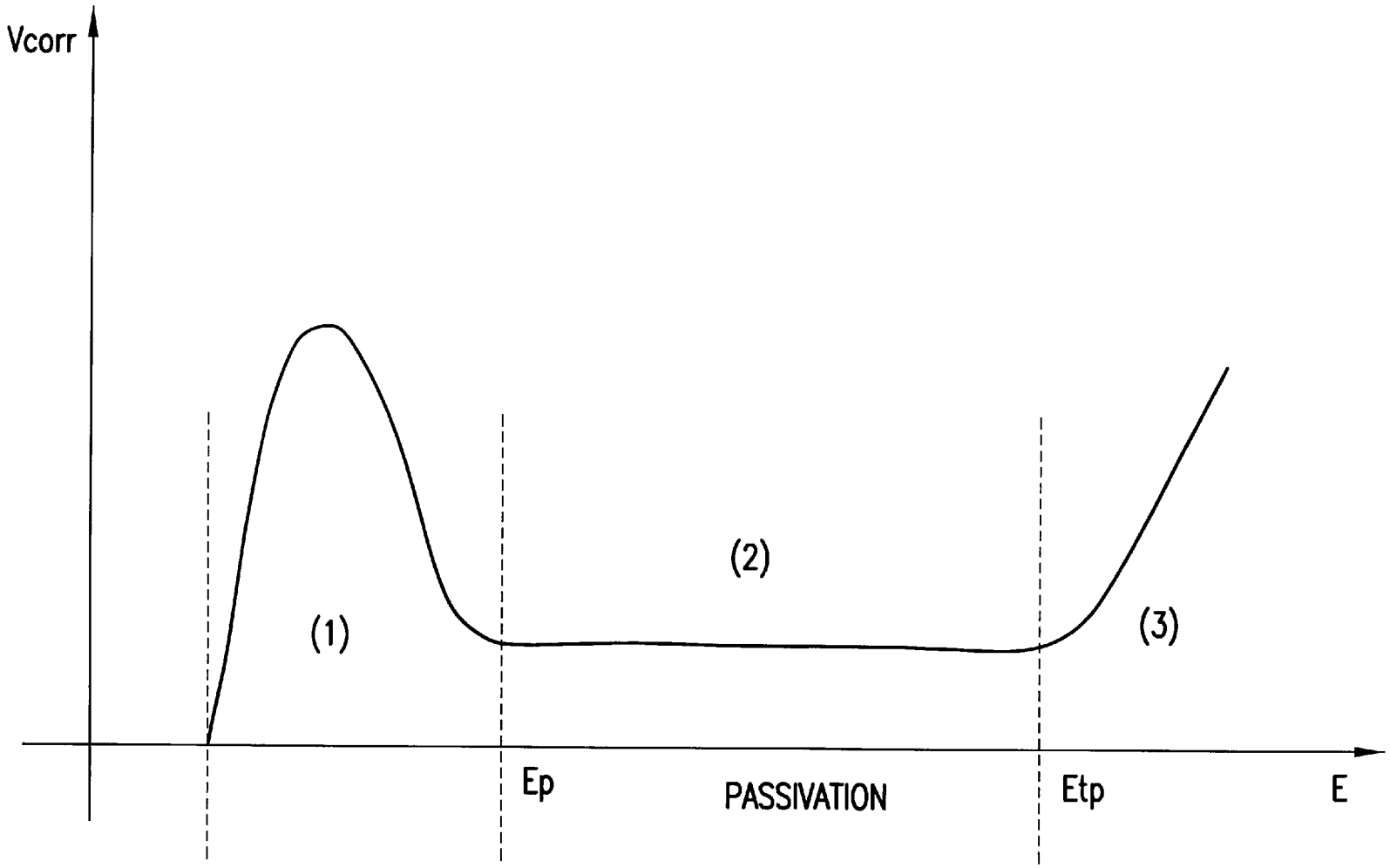
SINGLE FIGURE

PASSIVATION OF STAINLESS STEELS IN ORGANOSULPHONIC ACID MEDIUM

FIELD OF THE INVENTION

The present invention relates to the field of stainless steels and to that of organosulohonic acids. The invention relates more particularly to the protection of stainless steels against corrosion by organosulphonic acids such as methanesulphonic acid.

BACKGROUND OF THE INVENTION

Methanesulphonic acid (MSA) is a strong acid which has found many applications, in particular in catalysis and in the treatment of surfaces (galvanoplasty, stripping, descallng, etc.). However, aqueous MSA solutions attack stainless steels; the rates of corrosion depend, simultaneously, on the MSA concentration, the temperature and the nature of the stainless steel. Thus, at room temperature, 304L-type stainless steel can be corroded with MSA concentrations of greater than $10^{-2}$ mol/litre. Obviously, this seriously limits the fields of use of MSA.

In order to protect stainless steels against corrosion by sulohonic acids (in particular p-toluenesulphonic acid and polystyrenesulphonic acid), it has been proposed in patent application JP 07-278,854 to add a copper salt to these acids. That document is directed more particularly towards protecting the apparatus made of stainless steel (304 and 316 type) which are used in plants for the synthesis of alcohols from olefins and water in the presence of an organosulphonic acid as catalyst. The temperature range illustrated in that document is from room temperature to about 100° C.

In the article entitled "Corrosion of stainless steel during acetate production" published in July 1996 in the review Corrosion Engineering Vol. 2, No. 7, page 558, J. S. Qi and J. C. Lester indicate that the use of copper sulphate during esterification in the presence of sulphuric acid or p-toluenesulphonic acid allows the corrosion of 304L and 316L stainless steels to be reduced considerably.

However, the static tests carried out on compositions of MSA and copper(II) salts at temperatures of between 100 and 150° C. show that a thin layer of relatively non-adherent copper metal forms on the surface of the materials tested (AISI 304L and 316L). During the industrial use of this method, sedimentation of particles of copper metal at the bottom of the reactor was in fact observed, these particles being liable to cause serious damage to the recycling pumps or to harm the quality of the manufactured product. An additional step of filtration is thus necessary in order to remove these copper particles originating from the film deposited on the walls of the reactor. In fact, during changes in operating conditions (for example temperature, pressure, rate of stirring), this protective film detaches very easily.

DESCRIPTION OF THE INVENTION

It has now been found that stainless steels can be effectively protected, over a wide temperature range, against corrosion by organosulphonic acids, and in particular by MSA, by adding to the medium an oxidizing agent chosen from cerium(IV), iron(III), molybdenum(VI) or vanadium (V) oxides or salts, nitrites and persulphates.

The subject of the invention is thus a process for protecting stainless steels against corrosion by an organosulphonic acid, characterized in that at least one oxidizing agent chosen from cerium(IV), iron(III), molybdenum(VI) or vanadium(V) oxides or salts, nitrites and persulphates is added to the aqueous organosulphonic acid solution.

The subject of the invention is also an aqueous organosulphonic acid solution containing at least one oxidizing agent chosen from cerium(IV), iron(III), molybdenum(VI) or vanadium(V) oxides or salts, nitrites and persulphates, in an amount which is sufficient for its spontaneous potential, measured using a stainless steel electrode, to be within the passivation zone determined under the same conditions in the absence of the oxidizing agent.

Stainless steels are passivatable materials. Physically, passivation is due to the formation of a layer of oxides on the metal surface. Passivation is finally imparted to the alloy by the development of an adhesive layer which is relatively thin but of very low ionic permeability. The transfer of cations from the metal to the solution can be considered as being very considerably slowed down, and in certain cases virtually negligible. Indeed, the phenomenon of passivation should be considered as a state of dynamic equilibrium.

DESCRIPTION OF THE DRAWING

The rate or dissolution (v) of a stainless steel immersed in a medium such as an aqueous 1M MSA solution depends on the set electrochemical potential E. The curve v=f(E) has a typical shape which, as shown in the single figure attached, essentially comprises three parts, namely:

- an "activity" zone 1 corresponding to the anodic dissolution of the metal (oxidation),
- a "passivation" zone 2 located between a passivation potential (Ep) and a transpassivation potential (Etp),
- a "transpassivation" zone 3 in which the metal once again becomes active by oxidation of the passive film into a soluble substance (dissolution of $Cr_2O_3$ as $CrO_4^{2-}$).

At the passivation potential Ep, the rate of corrosion falls sharply to a very low value. In zone 2, the very low rate of dissolution thus corresponds to a region of corrosion resistance. Measurement of the spontaneous potential and its comparison with Ep and Etp makes it possible to determine instantaneously whether or not the stainless steel is corroding.

Provided that it is soluble in the organosulphonic acid or in the aqueous organosulphonic acid solution, the nature of the oxidizing agent chosen is not critical, and any soluble cerium(IV), iron(III), molybdenum(VI) or vanadium(V) oxide or salt can thus be used, as can any soluble nitrite or persulphate.

The following are more particularly preferred:

- alkali metal, ammonium or copper nitrites, and more especially sodium nitrite,
- ammonium cerium (IV) double salts such as ammonium cerium nitrate or sulphate.

As non-limiting examples of other oxidizing agents according to the invention, mention may also be made of iron(III) sulphate, ferric chloride, ferric nitrate, ferric perchlorate, ferric oxide, sodium molybdate, ammonium molybdate tetrahydrate, molybdenum oxide, sodium metavanadate, vanadium oxytrichloride, vanadium pentoxide, sodium persulphate and ammonium persulphate.

The amount of oxidizing agent according to the invention to be used can vary within a wide range; it depends, inter alia, on the nature of the oxidizing agent and on the organosulphonic acid concentration. When a ceric salt is used, the concentration of $Ce^{4+}$ ions is generally between $1\times10^{-5}$ and $1\times10^{-1}$ mol/litre; it is preferably between $1\times10^{-4}$ and $5\times10^{-2}$ mol/litre.

When a nitrite or another oxidizing agent is used, the amount used is generally between $1\times10^{-4}$ and 1 mol/litre; it is preferably between 0.001 and 0.5 mol/litre.

A particularly advantageous way to carry out the process according to the invention consists in associating a molybdenum (VI) salt, preferably sodium molybdate, with a cerium (IV) salt, preferably an ammonium cerium (IV) double salt. The amount of each salt to be used can vary within a wide range, but it is preferably between $1\times10^{-3}$ and $2\times10^{-2}$ mol/litre and, more particularly, between $5\times10^{-3}$ and $1\times10^{-2}$ mol/litre.

Although the process according to the invention is directed more especially at protecting common stainless steels (such as AISI 304L and 316L), it can apply generally to any stainless steel as defined in the standard NF EN 10088-1.

The invention relates more particularly to methanesulphonic acid (MSA). The protection process according to the invention can nevertheless be applied to other alkanesulphonic acids, for example ethanesulphonic acid, or to aromatic sulphonic acids such as p-toluenesulphonic acid (PTSA).

EXAMPLES

In the following examples, which illustrate the invention without limiting it, the electrochemical and static tests were carried out by working as follows.

1. Electrochemical Tests

The test consists in dipping an electrode made from the test material into the test solution and in checking that its spontaneous potential, under stabilized conditions, is indeed in the passivation region. Before the test, a polarization is carried out in the region of the cathode for 30 seconds.

The electrolysis cell consists of a container which can contain 80 ml of the test solution and allows an assembly of three electrodes: a reference electrode (Ag/Ag Cl of the Thermag-Tacussel type), an auxiliary electrode (platinum) and a working electrode (test stainless steel).

2. Static Tests

These tests make it possible, on the one hand, to check the passivation of the materials and, on the other hand, to calculate the rate of corrosion.

The study of the corrosion by loss of mass is carried out starting out with metal plates which are cut up using a lubricated-disc saw. The surface area of these cut lengths, with approximate dimensions of 25×50×2 mm, is calculated with precision. These cut lengths of metal are pierced with a hole 6.5 mm in diameter which allows them to be attached to a Teflon sample holder.

Before immersing them in the test MSA solution, the cut lengths are degreased with acetone, stripped in an aqueous solution containing 15% of nitric acid and 4.2% of sodium fluoride, rinsed with demineralized water and then with acetone, dried with oil-free compressed air and weighed.

After immersing them for 8 or 30 days in the test MSA soiution, the cut lengths are washed with demineralized water and then with acetone, weighed, freed of any deposits (corrosion products) by mechanical cleaning, and weighed again.

The loss of mass, expressed in $g/m^2$.day, allows the rate of corrosion, expressed in mm/year, to be calculated.

EXAMPLE 1

Since the electrochemical tool is particularly suitable for checking the passive states of stainless steels, electrochemical tests were carried out at 45 and 90° C. for an MSA concentration of 2.08 M and for two grades of stainless steel (AISI 304L and 316L subjected beforehand to a thermal overhardening treatment according to standard NF A35-574. The corrosive baths consisted of aqueous MSA solutions at 2.08 mol/litre containing variable amounts of sodium nitrite or of ammonium cerium (IV) nitrate.

The results obtained are collated in Tables I and II below, which indicate, in mV, the passivation, spontaneous and transpassivation potentials (E).

TABLE I

Electrochemical tests in 2.08 M MSA for 316L stainless steel

| Temperature | 45° C. | 90° C. | 45° C. | 90° C. |
|---|---|---|---|---|
| Additive and its concentration | $NaNO_2$ | | $(NH_4)_2Ce(NO_3)_6$ | |
| (mol/liter) | 0.05 | 0.08 | 0.005 | 0.01 |
| E passivation | -100 | 255 | 25 | 0 |
| E spontaneous | 540 | 615 | 1000 | 420 |
| E transpassivation | 1100 | 690 | 1100 | 758 |

TABLE II

Electrochemical tests in 2.08 M MSA tor 304L stainless steel

| Temperature | 45° C. | 90° C. | 45° C. | 90° C. |
|---|---|---|---|---|
| Additive and its concentration | $NaNO_2$ | | $(NH_4)_2Ce(NO_3)_6$ | |
| (mol/liter) | 0.05 | 0.3 | 0.01 | 0.0175 |
| E passivation | −100 | −45 | 0 | 20 |
| E spontaneous | 600 | 400 | 1000 | 470 |
| E transpassivation | 1100 | 950 | 1150 | 950 |

The spontaneous potential is always between the passivation and transpassivation potentials. The risks of generalized corrosion are thus negligible.

EXAMPLE 2

In order to widen the results of Example 1, static tests were carried out at 150° C. The results are collated in Table III below.

TABLE III

Static tests at 150° C. in 2.08 M MSA

| Stainless steel | Additive and its concentration (mol/liter) | | Loss of mass ($g/m^2 \cdot day$) | Rate of corrosion (mm/year) |
|---|---|---|---|---|
| 316 L | None | — | >500 | >23 |
| | $NaNO_2$ | 0.16 | 0.29 | 0.013 |
| | $(NH_4)_2Ce(NO_3)_6$ | 0.01 | 3.15 | 0.14 |
| 304 L | None | — | >500 | >23 |
| | $NaNO_2$ | 0.3 | 0.27 | 0.013 |
| | $(NH_4)_2Ce(NO_3)_6$ | 0.0175 | 0.49 | 0.022 |

EXAMPLE 3

Working as in Example 1, the protective effect of other species for 316 L stainless steel was studied. These tests and their results are collated in Table IV below.

TABLE IV

| Additive and concentration (mol/liter) | $Fe_2(SO_4)_3$ 0.1 | $Na_2MoO_4$ 0.15 | $NaVO_3$ 0.1 | $(NH_4)_2S_2O_8$ 0.1 |
|---|---|---|---|---|
| Temperature (° C.) | 45 | 90 | 90 | 90 |
| E passivation | 0 | 373 | 0 | 331 |
| E spontaneous | 678 | 400 | 905 | 610 |
| E transpassivation | 1000 | 985 | 990 | 995 |

EXAMPLE 4

By using an aqueous 70% solution of MSA and an aqueous 65% solution of PTSA, three aqueous solutions $S_1$, $S_2$ and $S_3$ were prepared having the following composition by weight:

| | Content (%) in: | | |
|---|---|---|---|
| SOLUTION | MSA | PTSA | Water |
| $S_1$ | 24.5 | 9.75 | 65.75 |
| $S_2$ | 49 | 19.5 | 31.5 |
| $S_3$ | 0.5 | 0.2 | 99.3 |

Two oxidizing agents:

Ox.1=ammonium cerium (IV) nitrate

Ox.2=sodium molybdate were jointly used in variable proportions (5 to 10 mmol/litre) to passivate 304L and 316L stainless steels at different temperatures (45, 90 and 150° C.) in the solutions $S_1$, $S_2$ and $S_3$.

By operating as in the preceeding Examples, the passivation, spontaneous and transpassivation potentials were measured. The results obtained are collated in the following Tables V and VI. It can be seen that the spontaneous potential is always between the passivation and transpassivation potentials. The risks of generalized corrosion are thus negligible.

TABLE V 304L stainless steel

| Temp. (° C.) | Solution | Content (mmol/l) Ox. 1 | Ox. 2 | Potential (mV): passivation | spontaneous | transpassivation |
|---|---|---|---|---|---|---|
| 45 | $S_1$ | 10 | 5 | −50 | 200 | 1020 |
| " | " | 5 | 10 | −50 | 220 | 1020 |
| " | $S_2$ | 5 | 5 | 300 | 470 | 1100 |
| " | $S_3$ | 5 | 5 | 0 | 900 | 1400 |
| 90 | $S_1$ | 5 | 5 | −470 | −50 | 1020 |
| " | " | 10 | 10 | 300 | 380 | 1020 |
| " | $S_3$ | 10 | 5 | −100 | 848 | 900 |
| " | " | 5 | 10 | 0 | 300 | 800 |
| " | $S_2$ | 10 | 5 | 500 | 860 | 1100 |
| " | " | 5 | 10 | 300 | 760 | 1120 |
| 150 | $S_1$ | 10 | 5 | 80 | 185 | 1020 |
| " | " | 5 | 10 | 80 | 325 | 1020 |
| " | $S_3$ | 5 | 5 | 80 | 740 | 1020 |

TABLE VI 316L stainless steel

| Temp. (° C.) | Solution | Content (mmol/l) Ox. 1 | Ox. 2 | Potential (mV): passivation | spontaneous | transpassivation |
|---|---|---|---|---|---|---|
| 45 | $S_1$ | 10 | 5 | −60 | 720 | 1100 |
| " | " | 5 | 10 | −80 | 450 | 1020 |
| " | $S_2$ | 5 | 5 | 300 | 410 | 1100 |
| " | $S_3$ | 5 | 5 | 100 | 325 | 1200 |
| 90 | $S_1$ | 5 | 5 | 80 | 515 | 1020 |
| " | " | 10 | 10 | 300 | 494 | 1020 |
| " | $S_2$ | 10 | 5 | 100 | 500 | 1200 |
| " | " | 5 | 10 | 60 | 710 | 1200 |
| " | $S_3$ | 10 | 5 | −100 | 750 | 1080 |
| " | " | 5 | 10 | 80 | 130 | 1020 |

EXAMPLE 5

Static tests of corrosion were carried out at 45° C. (duration: 8 days) in more or less diluted aqueous solutions of MSA.

These solutions were prepared by adding water to a 70% solution of MSA containing 5 mmol/l of ammonium cerium (IV) nitrate and 5 mmol/l of sodium molybdate. For comparison, static tests were concurrently carried out with aqueous solutions of MSA without oxidizing agents.

In the following Tables VII and VIII which summarize the results obtained, the number shown in the "DILUTION" column indicates the proportion (% by volume) of 70% MSA in the aqueous solution of the test.

TABLE VII 304L stainless steel

| DILUTION | Rate of corrosion (μm/year) MSA without additives | MSA with additives |
|---|---|---|
| 1 | <5 | <5 |
| 5 | 465 | <5 |
| 10 | 331 | <5 |
| 25 | 541 | <5 |
| 50 | 398 | <5 |
| 100 | — | 45 |

TABLE VIII 316L stainless steel

| DILUTION | Rate of corrosion (μm/year) MSA without additives | MSA with additives |
|---|---|---|
| 1 | <5 | <5 |
| 5 | 75 | <5 |
| 10 | 157 | <5 |
| 25 | 190 | <5 |
| 50 | 160 | <5 |
| 100 | — | 45 |

What is claimed is:

1. Process for protecting against corrosion of stainless steel in contact with an organosulphonic acid, comprising adding an amount of at least one oxidizing agent selected from cerium(IV), iron(III), molybdenum(VI) or vanadium (V) oxides or salts, nitrites and persulphates to an aqueous solution of said organosulphonic acid, said amount being sufficient for the spontaneous potential of said aqueous organosulphonic acid solution, measured using a stainless steel electrode, to be within the passivation zone determined under the same conditions in the absence of said oxidizing agent.

2. Process according to claim 1, wherein an alkali metal nitrite is used.

3. Process according to claim 2, wherein the amount of nitrite is between $1\times10^{-4}$ and 1 mol/liter.

4. Process according to claim 1, wherein the cerium (IV) is used in the form of an ammonium cerium-(IV) double salt.

5. Process according to claim 4, wherein the concentration of $Ce^{4+}$ ions is between $1\times10^{-5}$ and $1\times10^{-1}$ mol/liter.

6. Process according to claim 1, wherein a molybdenum (VI) salt is admixed with a cerium (IV) salt.

7. Process according to claim 6, wherein the amount of each salt is between $1\times10^{-3}$ and $2\times10^{-2}$ mol/liter.

8. Process according to claim 1, wherein the organosulphonic acid is methanesulphonic acid.

9. Aqueous alkanesulphonic acid solution containing at least one oxidizing agent selected from cerium(IV), molybdenum(VI) or vanadium(V) oxides or salts, nitrites and persulphates, in an amount which is sufficient for its spontaneous potential, measured using a stainless steel electrode, to be within the passivation zone determined under the same conditions in the absence of said oxidizing agent.

10. Aqueous solution according to claim 9, wherein the oxidizing agent is an alkali metal nitrite, or an ammonium cerium (IV) double salt.

11. Aqueous solution according to claim 9, wherein said aqueous solution contains a molybdenum (VI) salt and a cerium (IV) salt.

12. Aqueous solution according to claims 9, wherein the organosulphonic acid is methanesulphonic acid.

13. Process according to claim 2, wherein the nitrite is sodium nitrite.

14. Process according to claim 3, wherein the amount of nitrite is between 0.001 and 0.5 mol/liter.

15. Process according to claim 4, wherein the salt is ammonium cerium nitrate or sulphate.

16. Process according to claim 5, wherein the concentration of $Ce^{4+}$ is between $1\times10^{-4}$ and $5\times10^{-2}$ mol/liter.

17. Process according to claim 6 wherein the salts are sodium molybdate and an ammonium cerium (IV) double salt.

18. Process according to claim 7, wherein the amount of each salt is between $5\times10^{-3}$ and $1\times10^{-2}$ mol/liter.

19. Aqueous solution according to claim 10, wherein the nitrite is sodium nitrite and the salt is ammonium cerium nitrate or sulphate.

20. Aqueous solution according to claim 11, wherein the salts are sodium molybdate and ammonium cerium (IV) double salt.

21. Aqueous alkanesulphonic acid solution containing at least one oxidizing agent selected from cerium (IV), molybdenum (VI) or vanadium (V) oxides or salts, and persulphates, in an amount which is sufficient for its spontaneous potential, measured using a stainless steel electrode, to be within the passivation zone determined under the same conditions in the absence of said oxidizing agent.

22. Aqueous solution according to claim 21, wherein said aqueous solution contains a molybdenum (VI) salt and a cerium (IV) salt.

23. Aqueous solution according to claim 22, wherein the molybdenum (VI) salt is sodium molybdate and the cerium (IV) salt is an ammonium cerium nitrate or sulphate.

* * * * *